United States Patent [19]

Bowne

[11] Patent Number: 5,019,489

[45] Date of Patent: May 28, 1991

[54] COLOR PHOTOGRAPHIC ELEMENT AND PROCESS

[75] Inventor: Arlyce T. Bowne, Rochester, N.Y.

[73] Assignee: Eastman Kodak Company, Rochester, N.Y.

[21] Appl. No.: 385,607

[22] Filed: Jul. 26, 1989

[51] Int. Cl.[5] ..... G03C 1/46; G03C 7/32

[52] U.S. Cl. ..... 430/379; 430/503; 430/552; 430/558

[58] Field of Search ..... 430/379, 505, 552, 558, 430/379, 505, 552, 558, 503

[56] References Cited

U.S. PATENT DOCUMENTS

| | | | |
|---|---|---|---|
| 3,758,308 | 9/1973 | Beavers et al. | 430/553 |
| 4,022,620 | 5/1977 | Okumura et al. | 430/389 |
| 4,404,274 | 9/1983 | Arai et al. | 430/393 |
| 4,567,134 | 1/1986 | Koboshi et al. | 430/372 |
| 4,622,287 | 11/1986 | Umemoto et al. | 430/505 |
| 4,690,888 | 9/1987 | Fujiwhara et al. | 430/549 |
| 4,748,100 | 5/1988 | Umemoto et al. | 430/505 |
| 4,791,050 | 12/1988 | Ogawa et al. | 430/506 |
| 4,840,886 | 6/1989 | Iijima et al. | 430/558 |
| 4,863,840 | 9/1989 | Komorita et al. | 430/505 |

FOREIGN PATENT DOCUMENTS

| | | | |
|---|---|---|---|
| 162328 | 4/1985 | European Pat. Off. | 430/543 |
| 200354 | 3/1986 | European Pat. Off. . | |
| 230659 | 12/1986 | European Pat. Off. | 430/558 |
| 231832 | 1/1987 | European Pat. Off. | 430/467 |
| 284239 | 3/1988 | European Pat. Off. . | |
| 60-222852 | 4/1984 | Japan | 430/549 |

OTHER PUBLICATIONS

Research Disclosure, Item No. 17643, 1978, *Research Disclosure*, vol. 176, Kenneth Mason Publications, Hampshire, England.

*Primary Examiner*—Charles L. Bowers, Jr.
*Assistant Examiner*—Janet C. Baxter
*Attorney, Agent, or Firm*—Richard E. Knapp

[57] ABSTRACT

A combination in a color photographic silver halide element and process of at least one red-sensitive silver halide emulsion layer comprising a particular phenolic cyan dye-forming coupler with at least one green-sensitive silver halide emulsion layer comprising a particular pyrazolo[3,2-c]-s-triazole coupler and at least one blue-sensitive silver halide emulsion layer comprising a particular pivaloylacetanilide yellow dye-forming coupler enables improved color saturation of dye images, better relation of speed to grain characteristics and reduced unwanted spectral absorption of dye images formed. This combination is particularly useful in color photographic silver halide materials and processes for forming improved reversal dye images.

6 Claims, No Drawings

COLOR PHOTOGRAPHIC ELEMENT AND PROCESS

This invention relates to a particular combination of (A) at least one red-sensitive silver halide emulsion layer comprising a particular phenolic cyan dye-forming coupler with (B) at least one green-sensitive silver halide emulsion layer comprising a particular pyrazolo[3,2-c]-s-triazole coupler, and (C) at least one blue-sensitive silver halide emulsion layer comprising a particular pivaloylacetanilide yellow dye-forming coupler in a color photographic element and process that enables formation of dye images having improved color saturation, better speed to grain characteristics and reduced unwanted spectral absorption. The invention relates particularly to such photographic elements and processes designed to form improved reversal dye images.

Color photographic recording materials typically contain silver halide emulsion layers sensitized to each of the red, green and blue regions of the visible spectrum with each layer having associated therewith a color-forming compound, typically a dye-forming coupler, that respectively yields a cyan, magenta or yellow image dye upon exposure and processing of the materials. The quality of the resulting color image is based primarily on the dye hues obtained from the respective color-forming compounds.

Combinations of couplers for color photographic recording materials have been explored for many years. Combinations of couplers in color photographic materials have been described in, for example, U.S. Pat. No. 4,622,287; U.S. Pat. No. 4,748,100; European Patent Application Nos. 230,659; 162,328; 231,832; 230,659 and Japanese Published Application No. 60-222,852. Attempts to alter absorption characteristics of image dyes in such materials has been typically focused on alterations of the structures of the coupler compounds. While this approach has involved a measure of success, the results in the final hue values of color images has not been predictable even after concentrated research efforts.

A continuing need has existed for a color photographic element and process, particularly such an element and process designed to provide an improved reversal dye image, that comprises a combination of couplers that provides improved color saturation of dye images, better relation of speed to grain characteristics and reduced unwanted spectral absorption of dye images formed with acceptable stability without the need for high levels of formaldehyde in processing compositions.

It has been found that such advantages are provided by a color photographic silver halide element comprising a support bearing at least one red-sensitive silver halide emulsion layer comprising at least one cyan dye-forming coupler, at least one green-sensitive silver halide emulsion layer comprising at least one magenta dye-forming coupler, and at least one blue-sensitive silver halide emulsion layer comprising at least one yellow dye-forming coupler wherein (A) the cyan dye-forming coupler is a phenolic coupler, particularly a 2- or 4-equivalent phenolic coupler, comprising in the 2-position a group —NHCO—$R^1$ wherein $R^1$ is perfluoroalkyl or perfluoroaryl and in the 5-position a group —NHCO—$R^2$ wherein $R^2$ is a substituted ballast group, preferably a substituted phenoxy, phenylsulfonyl, or phenyl ballast group;

(B) the magenta dye-forming coupler is a 2-equivalent pyrazolo[3,2-c]-s-triazole comprising a phenyl group in the 3-position or 6-position, particularly a substituted phenyl; and, (C) the yellow dye-forming coupler is a pivaloylacetanilide coupler comprising a substituted hydantoin or a phenoxy coupling-off group; when the coupling-off group is phenoxy, the anilide moiety contains ortho-alkoxy or ortho-aryloxy.

The couplers (A), (B) and (C) as described can be any cyan, magenta and yellow dye-forming couplers containing the described substituents that enable the color image formed upon exposure and processing of the described element to have the improved color saturation, better relation of speed to grain characteristics and reduced unwanted spectral absorption.

A preferred photographic element, as described, is such an element designed for use in a reversal photographic process, such as the E-6 process of Eastman Kodak Company, U.S.A.

The cyan dye-forming coupler (A) is preferably a coupler represented by the formula:

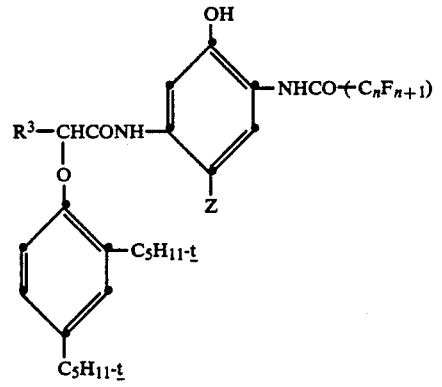

(I)

wherein $R^3$ is alkyl, such as alkyl containing 1 to 20 carbon atoms, for example, methyl, ethyl, n-butyl and eicosyl; n is 1, 2, 3 or 4; and, Z is hydrogen or a coupling-off group known in the photographic art. Typical couplers within (A) are described in, for example, U.S. Pat. No. 3,758,308.

Preferred examples of coupler (A) are:

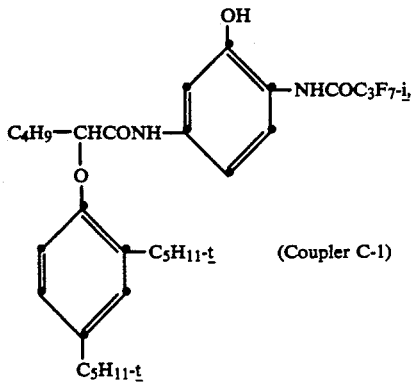

(Coupler C-1)

-continued

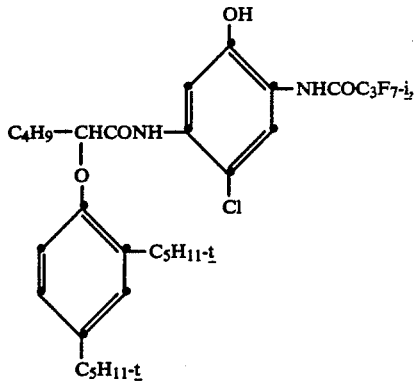

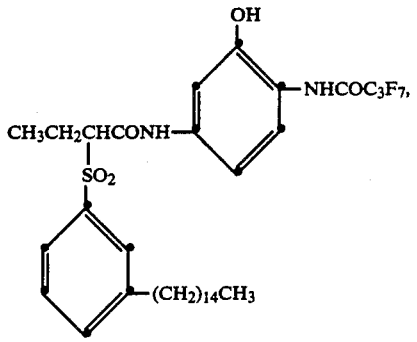

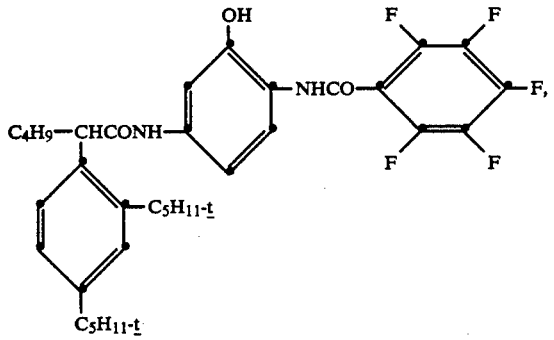

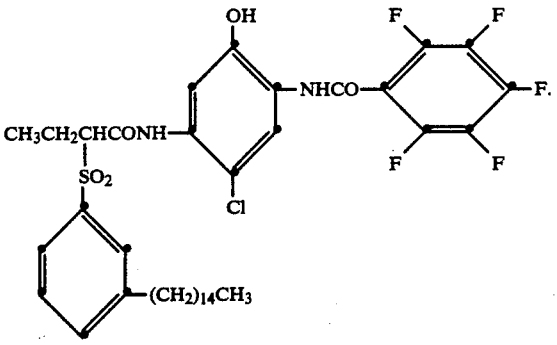

The magenta dye-forming coupler (B) is preferably represented by the formula:

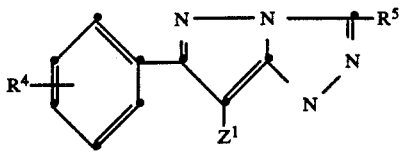

(II) (X)

or

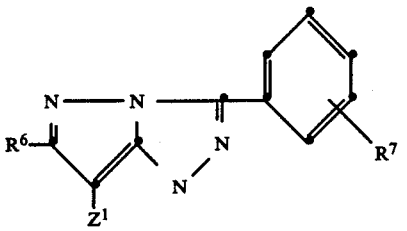

(II) (Y)

wherein $Z^1$ is hydrogen or a coupling-off group known in the photographic art, preferably chlorine; and, $R^4$, and $R^7$ individually are unsubstituted or substituted alkyl containing 1 to 4 carbon atoms, such as methyl, ethyl, propyl, n-butyl and t-butyl or alkoxy, particularly unsubstituted or substituted alkoxy containing 1 to 30 carbon atoms, such as methoxy, ethoxy, hexyloxy and dodecyloxy; and $R^5$ and $R^6$ individually are alkyl, such as methyl, ethyl, propyl, n-butyl and t-butyl. The phenyl groups containing $R^4$ and $R^7$ preferably also comprise a ballast group (BALL) known in the photographic art. Typical couplers within (B) are described in, for example, European Patent Applications No. 200,354, 284,239, and copending U.S. Ser. No. 265,197 of Bowne et al, filed Oct. 31, 1988, now issued as U.S. Pat. No. 4,892,805, and U.S. Ser. No. 265,155 of Harder filed Oct. 31, 1988, now issued as U.S. Pat. No. 4,948,722 the disclosures of which are incorporated herein by reference.

A particularly preferred magenta dye-forming coupler (B) is represented by the formula:

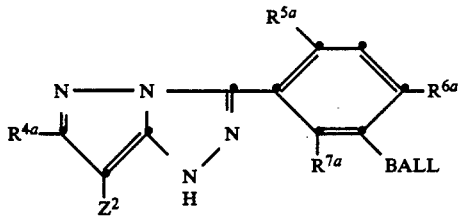

(III)

wherein $Z^2$ is hydrogen or a coupling-off group known in the photographic art, preferably chlorine; $R^{4a}$, $R^{5a}$, $R^{6a}$ and $R^{7a}$ individually are alkyl containing 1 to 4 carbon atoms, such as methyl, ethyl, propyl, n-butyl and t-butyl; and BALL is a ballast group known in the photographic art. Typical couplers within this formula are described in copending U.S. Ser. No. 171,061, filed Mar. 21, 1988 now abandoned, and European Patent Application No. 284,239, the disclosures of which are incorporated herein by reference.

Preferred examples of coupler (B) are:

(Coupler M-1)
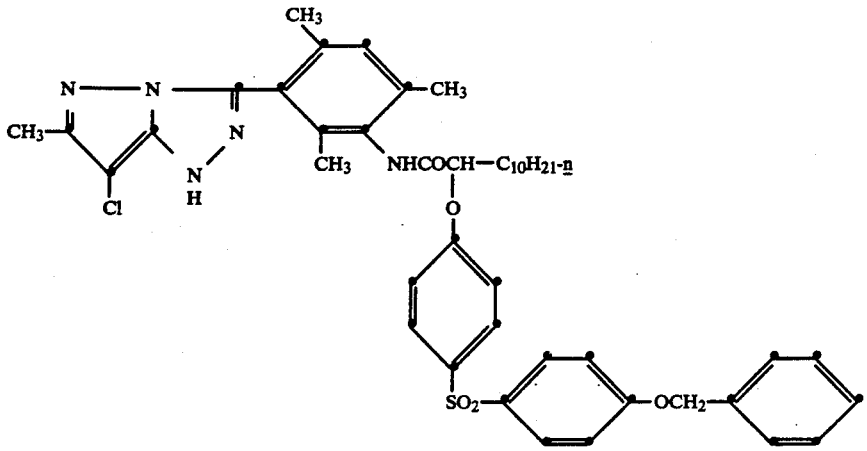
(Coupler M-2)
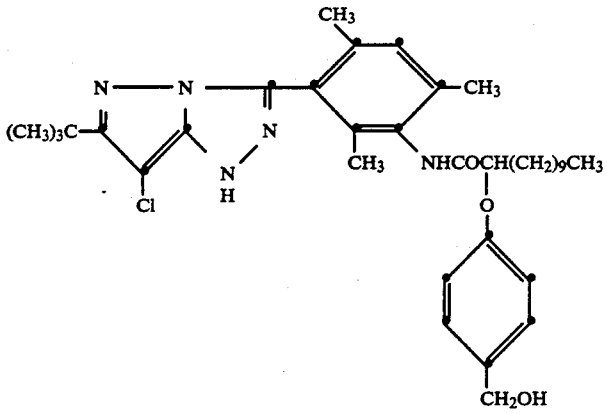
(Coupler M-3)
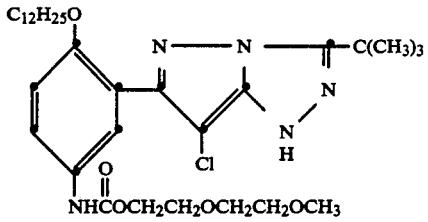
(Coupler M-4)
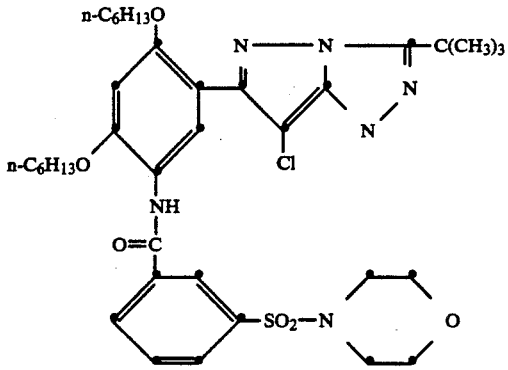
The yellow dye-forming coupler (C) is preferably represented by the formulas:

(IV)

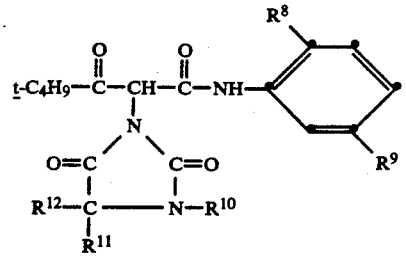

wherein $R^8$ is chlorine or alkyl containing 1 to 4 carbon atoms, such as methyl, ethyl, propyl, n-butyl, and t-butyl; $R^9$ is —$COOR^{13a}$ wherein $R^{13a}$ is a ballast group known in the photographic art; $R^{10}$ is a benzyl group; $R^{11}$ is hydrogen or alkyl, such as alkyl containing 1 to 4 carbon atoms, such as methyl, ethyl, propyl, or n-alkyl; and, $R^{12}$ is alkoxy, such as alkoxy containing 1 to 4 carbon atoms, for example, methoxy, ethoxy, propoxy and butoxy; or (V)

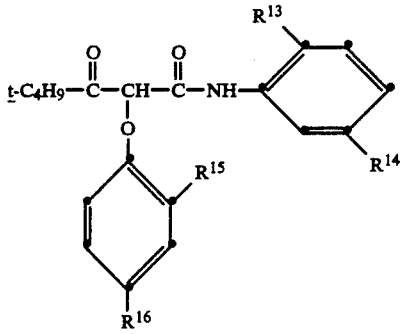

wherein $R^{13}$ is unsubstituted or substituted alkoxy, such as alkoxy containing 1 to 20 carbon atoms, for example, methoxy, ethoxy, propoxy, or butoxy; or unsubstituted or substituted aryloxy, such as aryloxy containing 6 to 20 carbon atoms, for example, phenoxy; $R^{14}$ is carbonamido (—$NHCOR^{17}$), carboxylic acid ester (—$COOR^{18}$), sulfamyl (—$SO_2NHR^{19}$), sulfonamido (—$NHSO_2R^{20}$), carbamyl (—$CONHR^{21}$) or esters $$(-O-\overset{O}{\overset{\|}{C}}-R^{21a});$$

$R^{15}$ and $R^{16}$ are individually hydrogen or substituents that do not adversely affect desired hue and enable desired reactivity. $R^{17}$, $R^{18}$, $R^{19}$, $R^{20}$, $R^{21}$ and $R^{21a}$ individually are substituents that do not adversely affect the described coupler, such as unsubstituted or substituted alkyl or aryl. At least one of $R^{13}$ and $R^{14}$ comprises a ballast group known in the photographic art. $R^{15}$ is preferably hydrogen or a group having ortho to the oxygen atom of the phenoxy group, a polarizable carbonyl, sulfonyl or phosphinyl substituent group, such as described in U.S. Pat. No. 4,401,752, the disclosures of which are incorporated herein by reference. $R^{16}$ is, for example, hydrogen or halogen, preferably chlorine, bromine or fluorine, alkyl, alkoxy, nitro, cyano, carboxy, alkoxycarbonyl, aryloxycarbonyl, alkylsulfonyl, arylsulfonyl, amido, carbamyl, sulfonamido or sulfamyl. $R^{15}$ is, for example, a group represented by the formula:

$$-\underset{R^{30}}{\overset{R^{29}}{(C)_m}}-A$$

wherein A is a group, as described in U.S. Pat. No. 4,401,752, preferably —$NHCOR^{22}$, —$CONR^{23}R^{24}$, —$SO_2R^{25}$, —$NHSO_2R^{26}$, or —$SO_2NR^{27}R^{28}$; m is 0 to 4; $R^{29}$ and $R^{30}$ are individually hydrogen, alkyl, or aryl; $R^{22}$, $R^{23}$, $R^{24}$, $R^{25}$, $R^{26}$, $R^{27}$ and $R^{28}$ individually are hydrogen, alkyl or aryl, preferably unsubstituted or substituted alkyl of 1 to 10 carbon atoms.

Preferred examples of coupler (C) are:

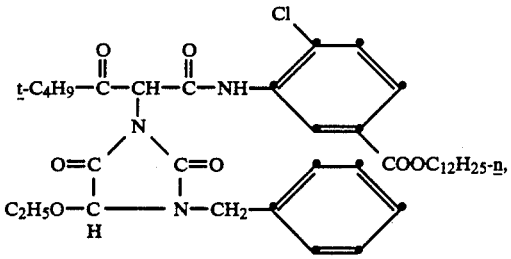

(Coupler Y-3)

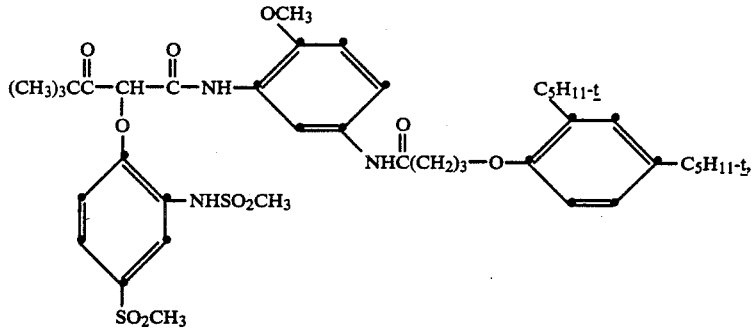

(Coupler Y-2)

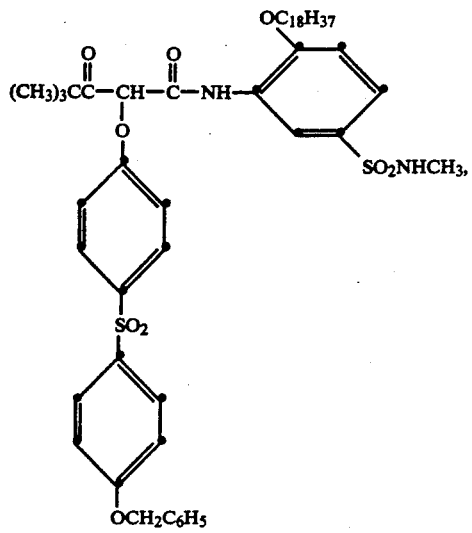

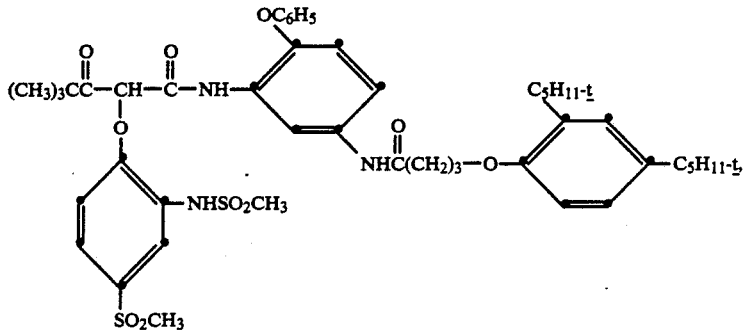

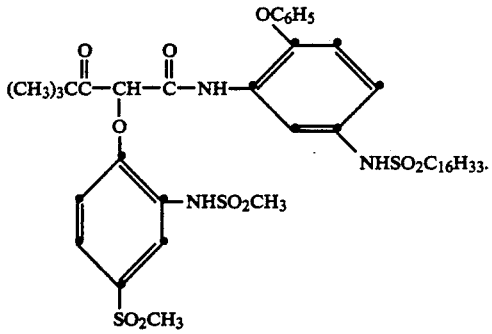

One embodiment of the invention is a color photographic silver halide element comprising a support bearing a red-sensitive silver halide emulsion layer comprising a coupler (A) as described, a green-sensitive silver halide emulsion layer comprising a coupler (B) as described, and, a blue-sensitive silver halide emulsion layer comprising a coupler (C) as described.

Another embodiment of the invention is a process of forming a photographic image by developing an exposed color photographic silver halide element as described with a color photographic developing agent, preferably a process for forming a positive (reversal) image comprising development of the exposed element as described first with a non-chromogenic developing agent to develop exposed silver halide, but not form dye, and then uniformly fogging the element to render the unexposed silver halide developable, followed by forming a color photographic image by development of the element with a color developing agent. Development is followed by the conventional steps of bleaching, fixing, or bleach-fixing, to remove silver or silver halide, washing and drying. Such a preferred process in which the described element is useful is the E-6 process of Eastman Kodak Company, U.S.A.

The described couplers can be used in the layers of the color photographic silver halide element in ways that couplers have been used in the photographic art. In the photographic element the couplers should be of such molecular size and configuration that they will not significantly diffuse or wander from the layer in which they are coated.

The color photographic silver halide element as described can be processed by techniques known in the photographic art for forming dye images. For example, for formation of a reversal image the color photographic silver halide element can be processed in a reversal process available in the photographic art, such as the E-6 process of Eastman Kodak Co., U.S.A.

The layers of the color photographic element as described, including the layers of the image-forming units, can be arranged in various orders known in the photographic art. The element can contain added layers, such as filter layers, interlayers, overcoat layers, subbing layers, and the like.

The coupling-off groups, as described, can be any coupling-off groups known in the photographic art, such as described in European Patent Application No. 284,239, that do not adversely affect the described photographic element and process.

The ballast group BALL, as described, can also be any ballast group known in the photographic art, such as described in European Patent Application No. 284,239, that does not adversely affect the described photographic element and process. Preferred ballast groups are those that enable a narrower half-band width (HBW) of absorption of the dye formed from the coupler.

In the following discussion of materials useful in the emulsions and elements of the invention, reference will be made to Research Disclosure, December 1978, Item No. 17643, published by Industrial Opportunities Ltd., Homewell Havant, Hampshire, PO9 1EF, U.K., the disclosures of which are incorporated herein by reference. The publication will be identified hereinafter by the term "Research Disclosure".

The silver halide emulsions employed in the elements can be comprised of silver bromide, silver chloride, silver iodide, silver chlorobromide, silver chloroiodide, silver bromoiodide, silver chlorobromoiodide or mixtures thereof. The emulsions can include coarse, medium or fine silver halide grains. High aspect ratio tabular grain emulsions are specifically contemplated, such as those described by Wilgus U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated are those silver bromoiodide grains with a higher molar proportion of iodide in the core of the grain than in the periphery of the grain, such as those described in GB No. 1,027,146; JA No. 54/48,521; U.S. Pat. No. 4,379,837; U.S. Pat. No. 4,444,877; U.S. Pat. No. 4,665,012; U.S. Pat. No. 4,686,178; U.S. Pat. No. 4,565,778; U.S. Pat. No. 4,728,602; U.S. Pat. No. 4,668,614; U.S. Pat. No. 4,636,461; EP No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure*, Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyanines. Illustrative spectral sensitizing dyes are disclosed in *Research Disclosure*, Item 17643, cited above, Section IV.

Suitable vehicles for the emulsion layers and other layers of elements of this invention are described in Research Disclosure Item 17643, Section IX and the publications cited therein.

In addition to the couplers described herein the elements of this invention can include additional couplers as described in Research Disclosure Section VII, paragraphs D, E, F and G and the publications cited therein. These additional couplers can be incorporated as described in Research Disclosure Section VII, paragraph C and the publications cited therein.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure Section X), coating aids (Research Disclosure Section XI), plasticizers and lubricants (Research Disclosure Section XII), antistatic agents (Research Disclosure Section XIII), matting agents (Research Disclosure Section XVI) and development modifiers (Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine di-p-toluene sulfonic acid.

The couplers as described can be prepared by methods and steps known in the organic synthesis art.

A typical method of preparing a coupler (C) is described in U.S. Pat. No. 4,022,620. A typical method of preparing a coupler (B) is described in European Patent Application No. 284,239. A typical method of preparing a coupler (A) is described in U.S. Pat. No. 3,758,308.

The following examples further illustrate the invention:

EXAMPLE 1

Photographic Elements Comprising Couplers of the Invention

Photographic elements were prepared by coating a cellulose acetate-butyrate film support with a photosensitive layer containing a silver bromoiodide emulsion and 3.77 gm/m$^2$ gelatin. The cyan and magenta dye-forming couplers were coated with 0.91 gm Ag/m$^2$ at a level of 1.62 mmole/m$^2$ of the coupler. The yellow dye-forming couplers were coated with 0.76 gm Ag/m$^2$ at a level of 2.7 mmole/m$^2$ of the coupler. The magenta dye-forming couplers were dispersed in half their weight of tricresyl phosphate, while the yellow and cyan dye-forming couplers were dispersed in half their weight of di-n-butyl phthalate. The photosensitive layer was overcoated with a layer containing gelatin at 1.08 gm/m$^2$ and bis-vinyl-sulfonylmethyl ether at 1.75 weight percent based on total gelatin.

Samples of each element were imagewise exposed through a graduated-density test object and processed using E-6 processing solutions and methods with a shortened first development time of 2.5 minutes. The spectrophotometry of these samples at a density of one were measured and the resulting λmax and half-band width (HBW) measurements are listed in Table I.

TABLE I

| Coupler | λmax | HBW |
|---|---|---|
| C-1 | 659 | 137 |
| M-A | 551 | 90 |
| M-B | 548 | 84 |
| M-1 | 555 | 80 |

TABLE I-continued

| Coupler | λmax | HBW |
|---|---|---|
| M-2 | 557 | 80 |
| M-3 | 553 | 80 |
| N-4 | 556 | 78 |
| Y-A | 449 | 89 |
| Y-2 | 440 | 89 |
| Y-3 | 447 | 85 |

Results for the listed couplers are given in following Table II.

TABLE II

| Couplers | | | | | | | |
|---|---|---|---|---|---|---|---|
| Cyan | Magenta | Yellow | | Blue C* | Green C* | Red C* | Red Q |
| C-1 | M-A | Y-A | (Comparison) | 80.9 | 46.2 | 72.3 | 32.2 |
| C-1 | M-A | Y-2 | (Comparison) | 83.0 | 49.5 | 71.0 | 30.9 |
| C-1 | M-A | Y-3 | (Comparison) | 82.3 | 48.6 | 72.1 | 31.7 |
| C-1 | M-1 | Y-A | (Comparison) | 91.6 | 48.4 | 82.6 | 35.1 |
| C-1 | M-B | Y-A | (Comparison) | 93.5 | 48.1 | 83.9 | 36.0 |
| C-1 | M-B | Y-2 | (Comparison) | 96.5 | 51.9 | 83.4 | 35.1 |
| C-1 | M-B | Y-3 | (Comparison) | 95.6 | 50.8 | 84.2 | 35.6 |
| C-1 | M-1 | Y-3 | (Invention) | 93.6 | 51.2 | 82.8 | 34.8 |
| C-1 | M-1 | Y-2 | (Invention) | 94.7 | 52.2 | 81.8 | 34.2 |
| C-1 | M-2 | Y-3 | (Invention) | 93.2 | 51.6 | 77.5 | 31.8 |
| C-1 | M-2 | Y-2 | (Invention) | 94.5 | 52.6 | 76.0 | 31.1 |
| C-1 | M-3 | Y-3 | (Invention) | 90.7 | 50.9 | 81.3 | 34.9 |
| C-1 | M-3 | Y-2 | (Invention) | 91.8 | 52.0 | 80.1 | 34.3 |
| C-1 | M-4 | Y-3 | (Invention) | 87.3 | 51.6 | 75.4 | 31.5 |
| C-1 | M-4 | Y-2 | (Invention) | 86.4 | 50.6 | 76.7 | 32.1 |

Coupler M-A:

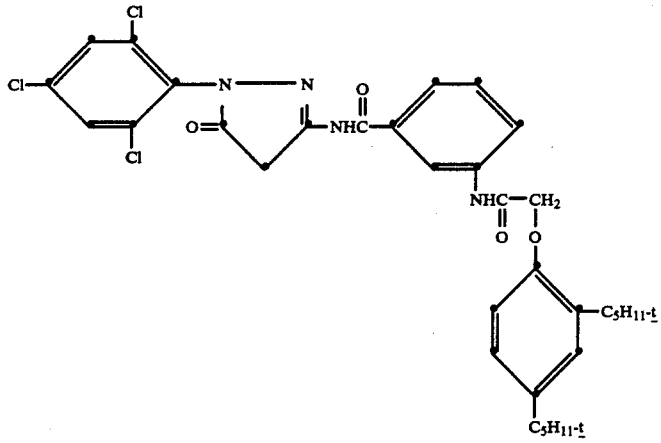

Coupler M-B:

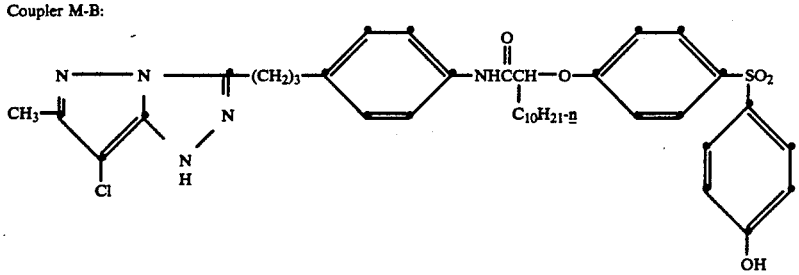

Coupler Y-A:

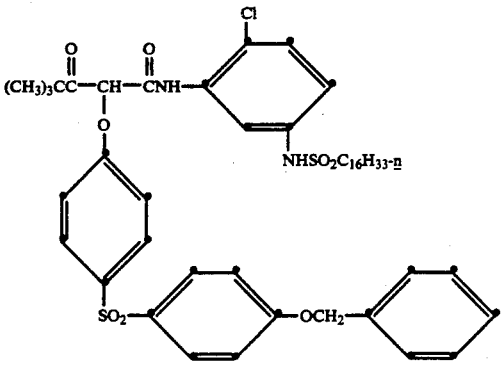

Using the full spectral absorption measurements for the image dyes along with measurements of tungsten illumination and spectral reflectances of test objects, the estimates of the reproduction of color saturation (C*) and hue angle (Q) for blue, green and red test objects in Table II were determined. Larger values of C* indicate increases in color saturation, while an increase in Q indicates a more orange reproduction of the red test object.

Combinations of the invention allow increases in color saturation, particularly without large movements from a given red color reproduction.

The invention has been described in detail with particular reference to particular embodiments thereof, but it will be understood that variations and modifications can be effected within the spirit and scope of the invention.

What is claimed is:

1. A color photographic silver halide element comprising a support bearing at least one red-sensitive silver halide emulsion layer comprising at least one cyan dye-forming coupler, at least one green-sensitive silver halide emulsion layer comprising at least one magenta dye-forming coupler and at least one blue-sensitive silver halide emulsion layer containing at least one yellow dye-forming coupler wherein (A) the cyan dye-forming coupler is a phenolic coupler comprising in the 2-position a group —NH-CO—$R^1$ wherein $R^1$ is perfluoroalkyl or perfluoroaryl and in the 5-position a group —NH-CO—$R^2$ wherein $R^2$ is a substituted ballast group;

(B) the magenta dye-forming coupler is a 2-equivalent pyrazolo-[3,2-c]-s-triazole represented by the formula:

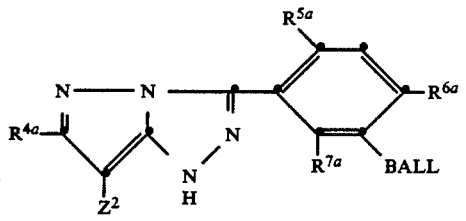

wherein $Z^2$ is hydrogen or a coupling-off group; and $R^{4a}$, $R^{5a}$, $R^{6a}$ and $R^{7a}$ individually are alkyl containing 1 to 4 carbon atoms; and BALL is a ballast group;

(C) the yellow dye-forming coupler is a 2-equivalent pivaloylacetanilide coupler comprising a substituted hydantoin or phenoxy coupling-off group; when the coupling-off group is phenoxy, the anilide moiety contains ortho-alkoxy or orthoaryloxy.

2. A color photographic element as in claim 1 wherein the cyan dye-forming coupler is represented by the formula:

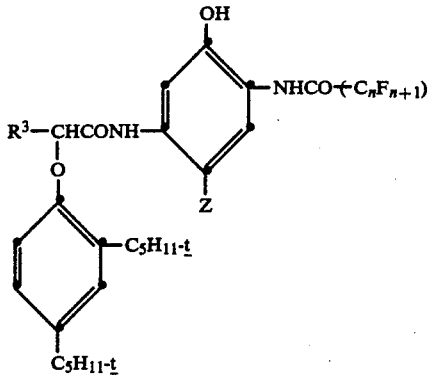

wherein $R^3$ is alkyl;

n is 1 to 4; and,

Z is hydrogen or a coupling-off group; the magenta dye-forming coupler is represented by the formula:

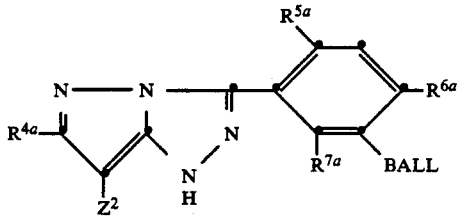

wherein $Z^2$ is hydrogen or a coupling-off group; and $R^{4a}$, $R^{5a}$, $R^{6a}$ and $R^{7a}$ individually are alkyl containing 1 to 4 carbon atoms; and BALL is a ballast group;

the yellow dye-forming coupler is represented by the formula:

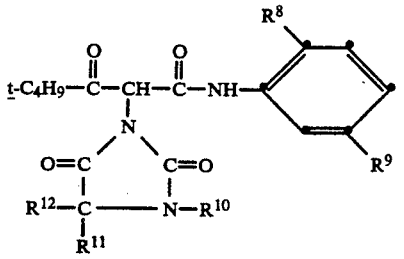

wherein $R^8$ is chlorine, alkyl containing 1 to 4 carbon atoms or alkoxy containing 1 to 4 carbon atoms;

$R^9$ is —$COOR^{13}$ wherein $R^{13}$ is a ballast group;

$R^{10}$ is benzyl;

$R^{11}$ is hydrogen or alkyl; and, $R^{12}$ is alkoxy.

3. A color photographic silver halide element comprising a support bearing at least one red-sensitive silver halide emulsion layer containing at least one cyan dye-forming coupler represented by the formula:

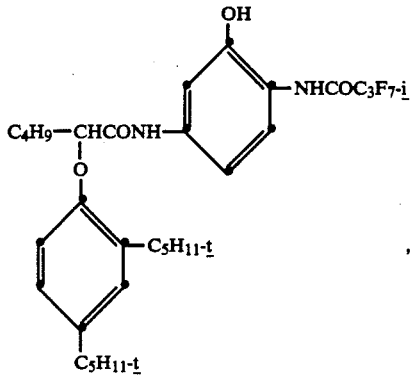

at least one green-sensitive silver halide emulsion layer containing at least one magenta dye-forming coupler represented by the formula:

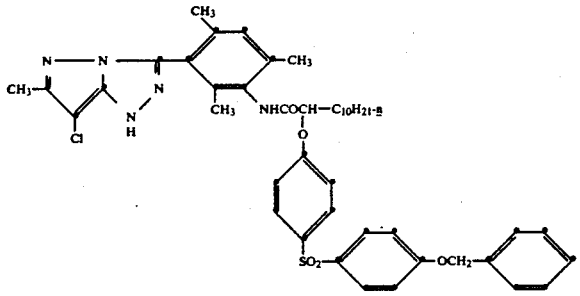

or

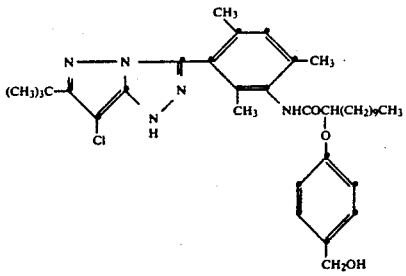

and at least one blue-sensitive silver halide emulsion layer containing at least one yellow dye-forming coupler represented by the formula:

4. A process of forming a dye image in an exposed photographic element as defined in claim 1, said process comprising the step of reacting at least one of the cou-

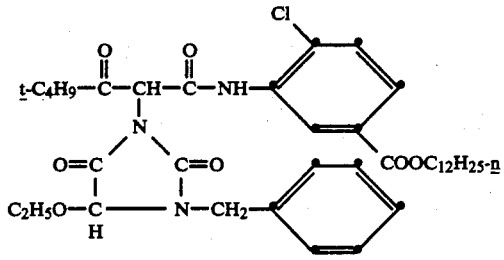

plers with an oxidized color developing agent to form a dye.

5. A process of forming a reversal dye image in an exposed photographic silver halide element as defined in claim 1, said process comprising the steps of black-and-white development with at least one black-and-white silver halide developing agent followed by a single color development of the element with at least one color developing agent to form a reversal dye image.

6. A process of forming a reversal dye image in an exposed photographic silver halide element as defined in claim 3, said process comprising the steps of black-and-white development with at least one black-and-white silver halide developing agent followed by a single color development of the element with at least one color developing agent to form a reversal dye image.

* * * * *

UNITED STATES PATENT AND TRADEMARK OFFICE

CERTIFICATE OF CORRECTION

PATENT NO. : 5,019,489

DATED : May 28, 1991

INVENTOR(S) : Arylce T. Bowne

It is certified that error appears in the above-identified patent and that said Letters Patent is hereby corrected as shown below:

Column 18, lines 14 - 22, Chemical structure should be immediately following the text in Column 17, line 66 "represented by the formula:".

Signed and Sealed this

Sixteenth Day of March, 1993

*Attest:*

STEPHEN G. KUNIN

*Attesting Officer*

*Acting Commissioner of Patents and Trademarks*